US008643278B2

(12) United States Patent
Chiang et al.

(10) Patent No.: US 8,643,278 B2
(45) Date of Patent: Feb. 4, 2014

(54) LOW PROFILE TRANSFORMER

(75) Inventors: Cheng-Chung Chiang, Taoyuan County (TW); Yuan-Tan Huang, Taoyuan County (TW); Wen-Hsiang Wu, Yilan County (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 94 days.

(21) Appl. No.: 13/407,800

(22) Filed: Feb. 29, 2012

(65) Prior Publication Data

US 2012/0223641 A1 Sep. 6, 2012

(30) Foreign Application Priority Data

Mar. 1, 2011 (CN) ..... 2011 2 0056678 U

(51) Int. Cl.
*H01J 7/44* (2006.01)

(52) U.S. Cl.
USPC ..... 315/70

(58) Field of Classification Search
USPC ..... 336/200, 232, 212; 315/70, 100–106, 315/57, 276
See application file for complete search history.

(56) References Cited

U.S. PATENT DOCUMENTS 7,710,230 B2 * 5/2010 Hsueh et al. ..... 336/92

* cited by examiner

*Primary Examiner* — Tuyen Nguyen
(74) *Attorney, Agent, or Firm* — Li&Cai Intellectual Property (USA) Office

(57) ABSTRACT

The instant disclosure relates to a low-profile transformer and methods of providing the transformer. The transformer in accordance with the present invention comprises a core unit having a pair of opposingly arranged base portions, an inserting portion, and at least a primary coil and a secondary coil wound around the inserting portion. The top-facing edge of the lateral portions is chamfered to enable tighter fitment into a receiving housing, such as a light tube. The transformer may also include a frame unit having a rounded flange that conforms to the shape of the wound coil. The instant disclosure further provides a method for providing a low-profile transformer that is particularly suitable for adapting in a tubular light device. The physical features and dimension of the transformer may be determined by methods that utilize the analysis of a characteristic equation in accordance with specific operating requirements.

6 Claims, 9 Drawing Sheets

LOW PROFILE TRANSFORMER

BACKGROUND OF THE INVENTION

1. Field of the Invention

The present invention relates to a transformer; and pertains particularly to a low profile transformer suitable for adapting in a light tube of a tubular LED light. The present invention further discloses a LED tubular light utilizing the low profile transformer and methods of providing a low profile transformer of predetermined operational and material specifications adaptable into a receiving housing such as a tubular light with a predetermined available housing space.

2. Description of Related Art

As light emitting diode (LED) technology growing mature, the illumination efficiency of these solid state light source devices has increased drastically. The improvement in lighting efficiency has led to wide adaptation of the LED lighting devices. Moreover, the integration of the built-in switching-type power supply with the LED lighting device enables these power-efficient solid state lighting devices to be operated directly under conventional alternating current (AC) conditions. Thus, various tubular LED lighting devices are developed to replace the less environmentally-friendly fluorescent lamps.

The lighting elements in a tubular LED light are usually driven by a transformer. However, the available space in a tubular light housing is limited. In addition, the placement of the hosting circuit board (on which a plurality of LED lighting elements is disposed) would affect the illuminating angle of the LED light source. If the transformer is too thick or occupies too much space, the hosting circuit board may have to be placed at an unfavorable position that would adversely affect the illuminating angle of the LED elements. Conventionally, the design of a transformer subject to specialized fitment requirements is often an intuitive yet effort-taking trial-and-error process.

SUMMARY OF THE INVENTION

In view of the draw-backs of the conventional approaches for the aforementioned problems, an object of the present invention is to provide a low profile transformer of minimized special requirement suitable for adapting in a light tube of a tubular LED light. Particularly, the low profile transformer may enable proper placement of the electronic components (particularly the hosting circuit board) to maximize the illuminating angle of the included LED lighting elements.

Embodiment in accordance with the present invention provides a transformer that comprise a frame unit (10) comprising a generally tubular hollow structure having two opposite ends arranged along a long axis, the hollow structure defining a core channel (1011) and a core unit coupled to the frame unit. The core unit comprises a pair of core members (20). Each core member (20) is a substantially E-shaped structure having a base portion (201), an inserting portion (202), and a pair of lateral portions (203). The inserting portion is arranged between the lateral portions, the inserting portion and the lateral portions extend abreast from the base portion. The inserting portion (202) of each core member (20) is conformally shaped for fittingly inserting into the core receiving channel (1011). The top-facing edge of the lateral portions (203) is preferably chamfered. The base portion (201) of the iron core (20) abuts the flange (102) of the frame (10) upon insertion of the core members (2) into the respective ends of the frame unit (10).

Embodiment in accordance with the present invention also provides a tubular light that comprises a light tube (31), a circuit board (32) disposed in the light tube, at least one illuminating element (33) disposed on the circuit board, and a transformer (1), which is designed in accordance to the abovementioned structural characteristics, disposed on the circuit board and electrically connected to the at least one illuminating unit.

Embodiment in accordance with the present invention further provides a method for providing a low profile transformer of predetermined operational and material specifications adaptable into a receiving housing. The transformer comprises a core unit having a pair of core members (20), each core member (20) having a base portion (201), an inserting portion (202), and a pair of lateral portions (203). The method includes the following steps (not necessarily following the listed order):

(a) Providing the receiving housing having a first cross section, defining a first available area in the first cross section for receiving the transformer.

(b) Determining an actual effective cross-sectional area (($A_{e_act}$) of the inserting portion (202), where the ($A_{e_act}$) is less than the first available area.

(c) Selecting an available coil winding width (W), wherein (W) is not greater than the distance between the inserting portion (202) and either one of the lateral portions (203).

(d) applying the predetermined operational and material specifications to a characteristic equation to selectively provide a characteristic effective area function $A_e(N_p, N)$ and a characteristic magnetic flux variation function $\Delta B(N_p, N)$, where the characteristic equation is defined as $$A_e = \frac{V_{in_min} D(V_{in_min}, N, V_o)}{N_p \Delta B \cdot fre}$$

$A_e$ denotes an effective cross-sectional area of an inserting portion in [mm^2], $V_{in_min}$ denotes minimum AC (alternating current) input voltage in [V], N denotes winding ratio between primary and secondary windings, $V_o$ denotes DC output voltage in [V], D ($V_{in_min}$, N, $V_o$) denotes duty cycle, wherein $$\frac{D}{1-D} = N\frac{V_0}{V_{in_min}},$$

$N_p$ denotes primary winding number, $\Delta B$ denotes change in magnetic flux density in [Tesla], fre denotes operating frequency in [KHz].

(e) Selecting a suitable solution pair (Np, N) from the solution space of the characteristic effective area function $A_e(N_p, N)$ or the characteristic magnetic flux variation function $\Delta B(N_p, N)$.

(f) Obtaining a secondary coil winding number (Ns) from the solution pair (Np, N) for determining a total required coil winding area ($A_{total}$) using the selected Np and the corresponding Ns.

(g) Lastly, obtaining an available coil winding length (L) of the transformer (1) by dividing the total required coil winding area ($A_{total}$) by the available coil winding width (W).

In order to further the understanding regarding the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings. Please note that, the directional descriptions such as up/down/top/bottom are set in accordance to the illustrations of the drawings, which is only defined to provide clear and convenient descriptive reference.

Figure 1:
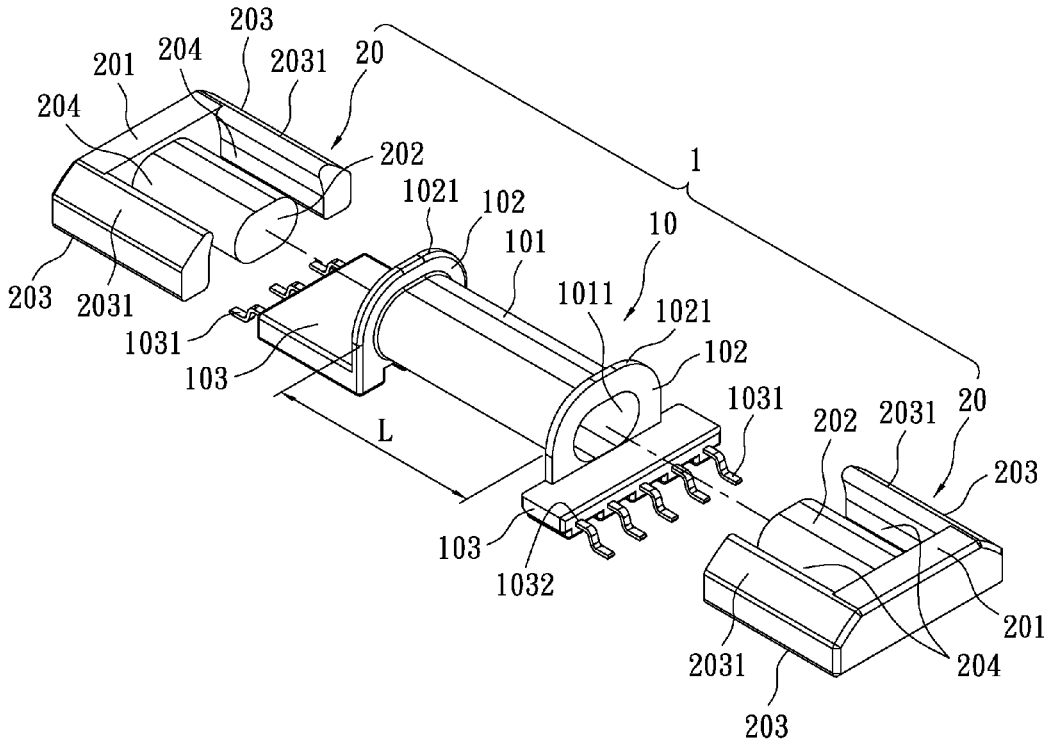
FIG. 1 shows a perspective exploded view of a transformer in accordance with the present invention.

Please refer to FIG. 1, which shows a perspective exploded view of an exemplary low profile transformer in accordance with the present invention. The low profile transformer (1) in accordance with the present invention includes a frame unit (10) and a core unit, which comprises a pair of core members (20) correspondingly coupled to the frame unit 10 from the respective opposite ends thereof.

In the instant embodiment, the frame unit (10), known as the bobbin, is a generally tubular hollow structure having two opposite ends arranged along a long axis. The hollow structure defines a core receiving channel (1011) for matingly receiving an iron core portion of the core members (20). Specifically, the frame unit (10) comprises a winding portion (101), a pair of flanges (102), and two connector portions (103). The winding portion (101) is defined between the flanges (102), while the connector portions (103) are respectively formed at the opposite ends of the frame unit (10) on the bottom surface thereof. It is worth noting that, however, the frame unit (10) is not necessarily required. In this case, the core members (20) would resume a generally tubular shape that has a long axis, around which the conductive coils can be wound.

Figure 5:
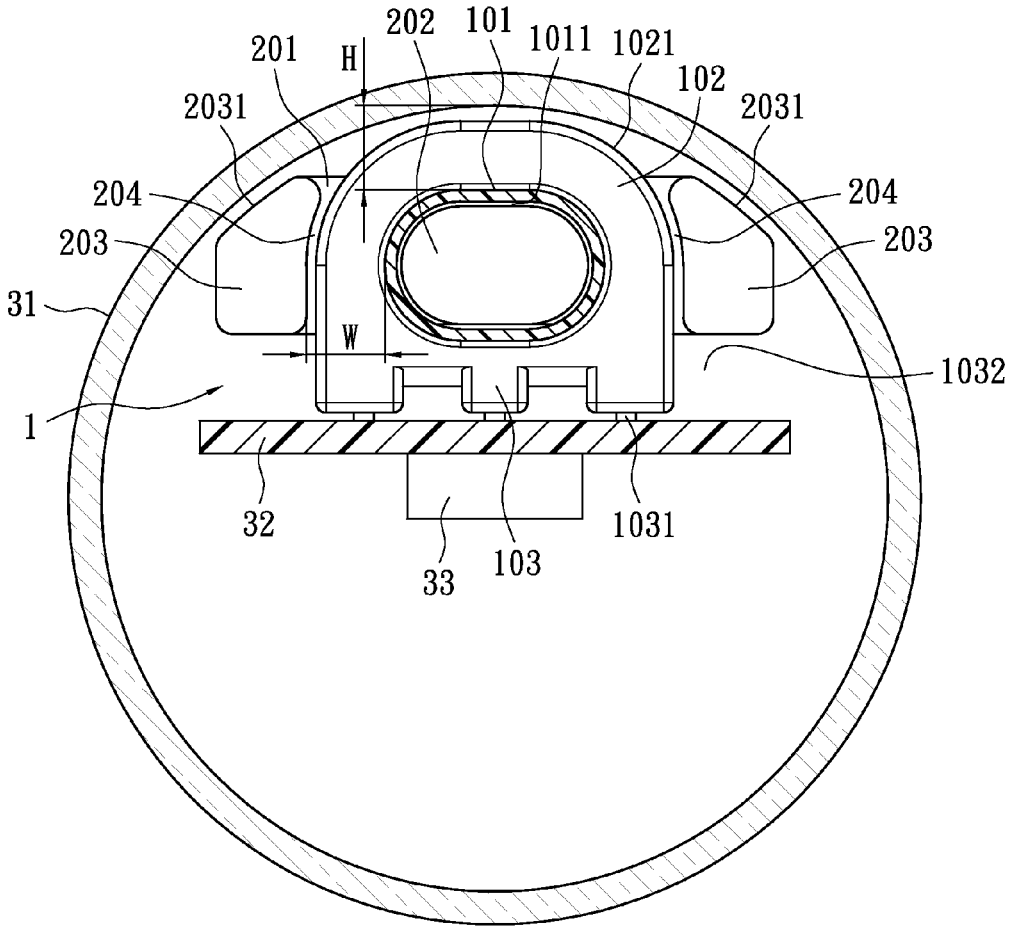
FIG. 5 shows a transverse cross-sectional view (across the A-A line shown in FIG. 4) of a tubular light that utilizes a transformer in accordance with the present invention.

Specifically, the winding portion (101) is defined on the hollow tubular portion of the frame unit (10). The winding portion (101) in this embodiment is preferably a transversely orientated hollow elliptical column for receiving coil windings (2). The hollow column structure of the winding portion (101) defines the core receiving channel (1011) for receiving the insertion portion (202) of the core member (20), whose structural details will be subsequently discussed. The pair of flanges (102) is respectively arranged at the opposite ends of the winding portion (101). Each of the flanges (102) extends radially outward and substantially perpendicular to the long axis of the frame unit (10). The winding portion (101), together with the flanges (102), serves as a reel for conductive coils to wind upon. The elliptical cross-section of the winding portion (101), which is arranged transversely on the frame unit (10), contributes to overall height (thickness) reduction of the transformer (1), allowing better/tighter fitment thereof into tubular lights (particularly in tubular lights with circular cross-sections). Likewise, the transverse cross-section of the core receiving channel (1011) is preferably elliptical. To further improve the fitment of the transformer (1) into a circular light tube, the edges (particularly the upper portion) of the flange (102) can be chamfered (such as the rounded/elliptically arced edge (1021) as illustrated in FIG. 5). Of course, the cross-section of the hollow winding portion (101) is not limited to elliptical shape; other shapes that can be transversely arranged while offering substantially the same coil winding area (such as a rectangular cross-section) may be adapted. Moreover, the low-profile transformer (1) in accordance with the present invention is adaptable in light tubes of cross-section other than circular shape, such as a rectangular or polygonal shape. For example, for fitting into a rectangular light tube, the flanges (102) can be arranged into a rectangular-shaped structure to enable tighter fitment in the light tube. The shape of the flange (102) may be arranged to adapt to light tubes of different cross-sectional shapes.

In the instant embodiment, the two connector portions (103) extend respectively and asymmetrically from the bottom surface of the opposite ends of the frame unit (10) along the long axis. Each connector portion (103) has a plurality of conducting pins (1031) disposed thereon for establishing electrical connection with a circuit board. Particularly, one end of each connector portion (103) of the instant exemplary embodiment is structurally connected to a respective flange (102). The other end of each connector portion (103) extends horizontally away from the winding portion (101) to form a surface mount device (SMD) interface (1032), from which the conducting pins (1031) protrudingly expose. Preferably, the conducting pins (1031) are arranged to expose horizontally from the SMD interface along the long axis of the frame unit (10). Such horizontal arrangement of conductive pins (1031) may further facilitate the reduction of transformer height (thickness).

Preferably, one of the connector portions (103) extends further away from the winding portion (101) than the other. The asymmetrical arrangement of the connector portion length effectively creates the necessary separation between the SMD interface (1032) (also the corresponding conductive pins (1031), which situates at a lower voltage during operation) and the winding portion (101) (which is at a higher voltage during operation) to reduce the likelihood of electrical interference between the high and low voltage ends of the transformer. Preferably, the longer connector portion (103) that expends further away from the winding portion (101) is correspondingly adapted to receive the secondary coil ($N_s$) that operates at lower voltage. The degree of length extension (or separation) of the connecting portions (103) may be determined in accordance to and in compliance with specific safety regulations.

Regardless, the specific layout of the connector portions (103) need not be limited to the exemplary embodiment discussed above. By way of example, both of the connector portions (103) may extend outwardly from the winding portion (101) (or more specifically, the flange portion (102)) along the long axis thereof, making the extended connector portions (103) substantially symmetrically arranged. As discussed above, the degree of length extension (or separation) of the connecting portions (103) may be determined in accordance to and in compliance with specific safety regulations.

The core unit comprises a pair of core members (20). Each core unit preferably includes a pair of opposingly arranged base portions (201), an inserting portion (202), and a pair of opposingly arranged lateral portions (203). In the instant embodiment, each core member (20) has a substantially E-shape structure, which respectively comprises a base portion (201), a centrally arranged inserting portion (202), and a pair of lateral portions (203). The inserting portion (202) and the lateral portions (203) extend abreast from the base portion (201). The transverse cross-section of the inserting portion (202) is preferably of elliptical shape, conforming to the transverse cross-sectional shape of the core receiving channel (1011). The lateral portions (203) are arranged on each side of the inserting portion (202) and are substantially equally spaced there-from, leaving gaps that define a pair of winding space (204) for passing transformer coils. Particularly, the top-facing outer edge of the lateral portions (203) is preferably chamfered. The chamfered surfaces (2031) on the core members (20), in cooperation with the rounded (elliptically arced) edge (1021) of the flange (102), enables tighter fitment of the transformer (1) in a circular light tube. Moreover, the top surface of the inserting portion (202) is preferably arranged lower than that of the lateral portions (203) (when viewed from a lateral direction), as can be seen from FIG. 5.

Figure 2:
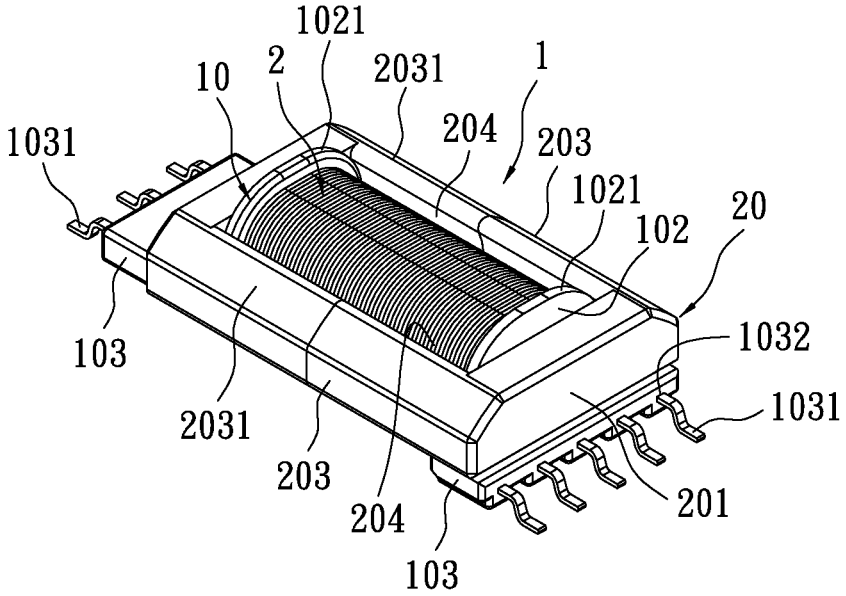
FIG. 2 shows a perspective diagram of a transformer in accordance with the present invention.
Figure 3:
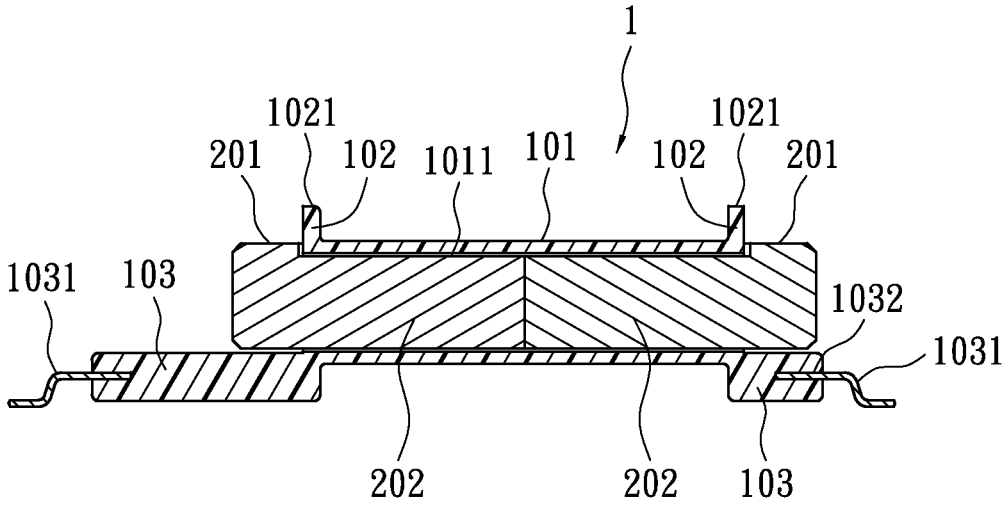
FIG. 3 shows a longitudinal cross-sectional side view of a transformer in accordance with the present invention

Please refer to FIGS. 2 and 3 in conjunction with FIG. 1. The inserting portion (202) of each core member (20) is conformally shaped for fitting into the core receiving channel (1011). Upon full insertion of the insertion portion (202) into the frame unit (10) at the respective ends thereof, the base portion (201) of the iron core (20) abuts the flange (102) of the frame (10). Preferably, the winding spaces (204) defined between the lateral portions (203) and the winding portion (101) of the frame (10) (or alternative, the space defined between the insertion portion (202) and the lateral portion (203), if the thickness of the winding portion (101) is neglectable) are calculatingly arranged to be just wide enough to pass enough turns of coils for achieving the desired transformer specification. The specific design consideration for lateral portions (203), as well as the methods of determining a suitable dimension for the winding space (204), will be provided in a later discussion.

In the instant embodiment, the length of the inserting portion (202) and the lateral portions (203) of each core member (20) are provided in a way such that, upon the complete insertion of the core members (20) into the respective ends of the winding portion (101), the tips of the insertion portion (202)/lateral portion (203) of each of the respective core members (20) establish contact with each other, thus combinatively forming the core unit. However, in some embodiments, the tip portions of the insertion portion (202) and/or the lateral portion (203) may be arranged without contacting each other, leaving a gap of predetermined width in between. The total length of the inserting portions (203) defines an "available coil winding length (L)," whose design consideration and method of determination will be discussed in a later section. Likewise, the extending ends of the lateral portions (203) of each respective core member (20) are arranged in a similar fashion that, upon assembly of the core members (20) onto the frame unit (10), the lateral portions (203) of the respective core members (20) correspondingly contact each other. Thus, upon the complete assembly of the transformer (1), the lateral portions (203), together with the base portion (201), horizontally and surroundingly enclose the winding portion (101) of the frame unit (10).

Using the fundamental equation of an inductor: vdt=Ldi and the physical dimensional characteristics of the transformer (1) (such as the number of coil turns, the coil winding area, and the effective cross-sectional area of the core unit, etc.), we may obtain a characteristic equation through the following derivation:

$$
\begin{aligned}
&Vdt = Ldi \\
&\Rightarrow N_p d\phi = Ldi \\
&\Rightarrow B_m = \frac{L_p \Delta i}{N_p A_e} = \frac{V_{in_min} \Delta t}{N_p A_e} \\
&\Rightarrow A_e = \frac{V_{in_min} D(V_{in_min}, N, V_o)}{N_p \Delta B \cdot fre} = A_e(N_p, N)
\end{aligned}
$$

wherein

1. $V_{in_min}$ denotes the minimum AC (alternating current) input voltage in Volts (the value of $V_{in_min}$ preferably ranges from 90 VAC for ordinary full voltage applications to 200 VAC for high voltage applications);
2. N denotes winding ratio between primary and secondary windings, and is preferably in the range of 0.9~6.5;
3. $V_o$ denotes the DC output voltage in Volts (depending on application requirements, $V_o$ preferably ranges from 10V to 50V);
4. D ($V_{in_min}$, N, $V_o$) denotes the duty cycle (which is a function of $V_{in_min}$, N, and $V_o$, and can be derived by a given N value through the following equation:

$$\frac{D}{1-D} = N\frac{V_0}{V_{in_min}}),$$

the value of D preferably ranges from 0~1;

5. $N_p$ denotes the turn number of primary winding (preferably ranged between 15~145);
6. ΔB denotes the change in magnetic flux density in Tesla (a physical characteristics of a particular material for the core unit and can be selected to fit specific operational requirements). Preferably, 0<ΔB≤0.35 T, and more preferably, ΔB=0.3 T;
7. fre denotes the operating frequency in KHz, which is a design parameter that may preferably range from 40 KHz to 120 KHz. The instant embodiment utilizes 60 KHz and 120 KHz;
8. $A_e$ denotes the effective cross-sectional area (or simply referred to as the cross-sectional area ($A_e$)) of the core unit, namely, the cross-sectional area of the inserting portion (202) (preferably less than 30 mm^2);
9. By plugging the pre-determined values for design parameters such as ($V_{in_min}$), ($V_o$), (ΔB), and (fre), we may obtain a characteristic function of Effective cross-section $A_e(N_p, N)$, which is a function of primary coil winding number ($N_p$) and coil winding ratio (N).

The operating frequency (fre) of the instant exemplary transformer is set in the range 60~120 KHz. Using the above-mentioned equation for $A_e$ (which is a function of the turn number of primary winding ($N_p$) and the turn ratio (N), we can further analyze the characteristics of the function and accordingly design a low profile transformer (of power rating between 8~40 Watt, for example) that has a suitable coil winding area.

Figure 8:
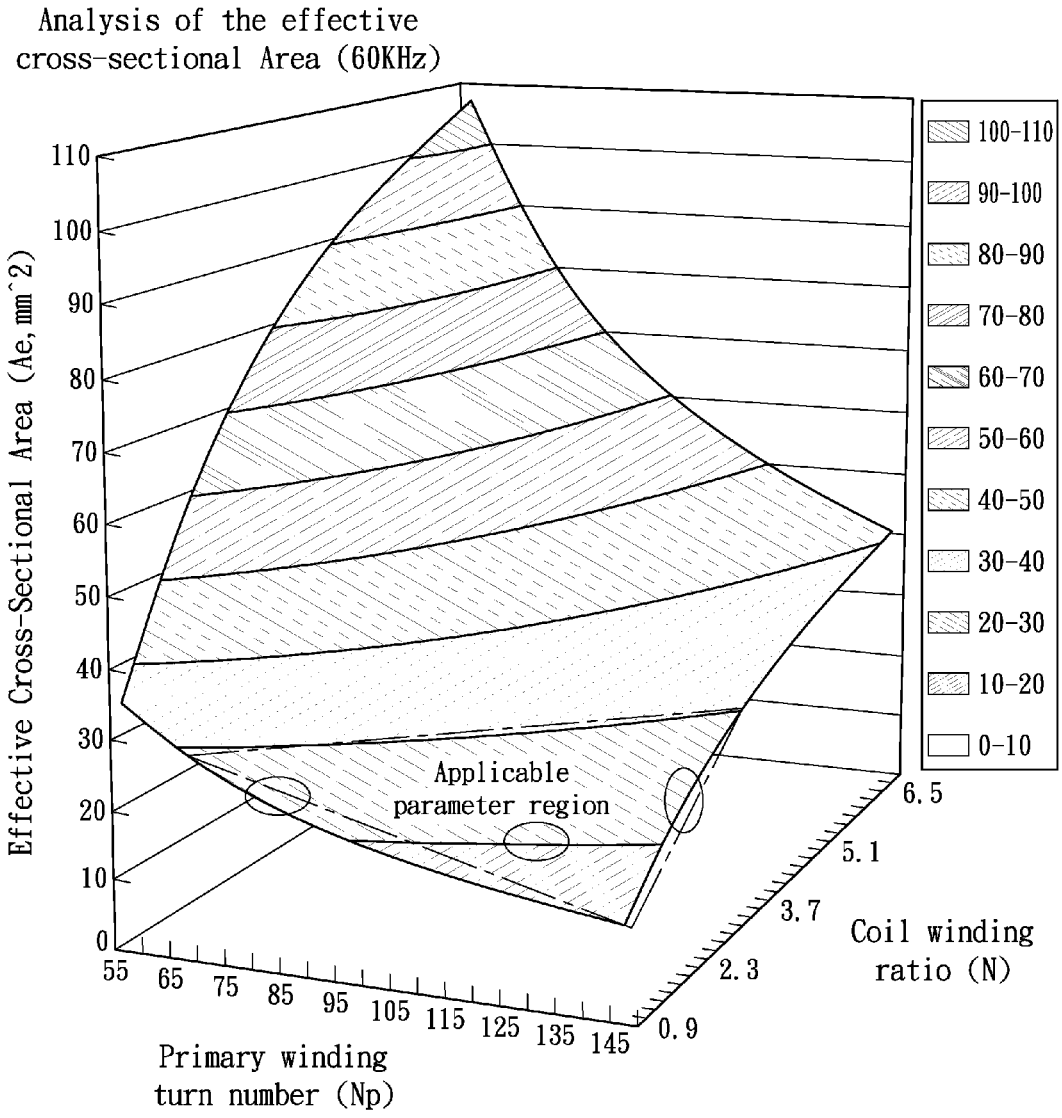
FIG. 8 illustrates an applicable parameter range in a three dimensional solution space for a characteristic function in accordance with the present invention.

For example, if the goal is to design a low profile transformer (1) having an operating frequency (fre) of 60 KHz and a power rating of 40 Watts, the coil winding area of the instant low profile transformer (1) can be determined and calculated by using the exemplary steps provided as follows:

1. Plugging $V_{in_min}$=90, $V_o$=50, ΔB=0.25 (a design parameter), fre=60K into the abovementioned characteristic equation to obtain a characteristic function $A_e(N_p, N)$, on which numerical analysis can be performed to obtain a three dimensional solution space as illustrated in FIG. 8;
2. Selecting a reference transformer (having known ΔB and $A_e$ values; we denote the cross-sectional area of the reference transformer as "$A_{e_ref}$", and adapt a value of, for example, 30 mm^2). If the physical dimension of the reference transformer is too large, the oversized transformer may negatively affect the illuminating angle of the lighting elements (33) or even render the transformer unsuitable for a given light tube (31). If this is the case, the preferred solution for a proper cross-sectional area of the low profile transformer (1) to be designed may fall in the range where $A_e$<30. Thus, referencing to the graphical 3-D solution space as shown in FIG. 8, we select a solution $N_p$=95 from within the $A_e$<30 range and obtain a corresponding coil winding turn ratio N=1.5;
3. Assuming the efficiency of the transformer to be 80%, from the given input power ($P_{in}$) of 40 W, we calculate the output power ($P_o$) to be 40*80%=32 W;
4. From the pre-set output voltage value ($V_o$)=50V, we obtain the output current ($I_o$)=32 W/50V=0.64 A; likewise, from the pre-set minimum input AC voltage value ($V_{in_min}$)=90V, we obtain the input current value ($I_{in}$)=40 W/90V=0.44 A;
5. The required cross-sectional area of the primary coil (Awp)=[input current]/[current density across the primary coil diameter]=0.44(A)/400(A/cm^2)=$11.1\times10^{-4}$ $cm^2$. Accordingly, the primary coil diameter (Ψp) can be obtained: $(\Psi p)=(4Awp/\pi)^{-5}$=0.37 mm;
6. The required cross-sectional area of the secondary coil (Aws)=[output current]/[current density across the secondary coil diameter]=0.64(A)/400(A/cm^2)=$16\times10^{-4}$ $cm^2$. The secondary coil diameter (Ψs) can then be obtained: $(\Psi s)=(4Aws/n)^{-5}$=0.45 mm;
7. From the above information, we can calculate the total required coil winding area. For example, selecting $N_p$=95 (turns), $N_s=N_p/N$=95/1.5=63 (secondary winding turns), the required primary coil winding area=95*π(Ψp/2)^2=10.21 (mm^2). Likewise, the required secondary coil winding area=63*π(Ψs/2)^2=10.07 (mm^2). Thus, the total required coil winding area=10.21+10.07=20.28 (mm^2). The value of the total required coil winding area should be less than or equal to the available coil winding area of the transformer (1). In other words, the available coil winding area of the instant transformer should be designed to have a size no less than the total required coil winding area calculated above.

It is to be noted that, to obtain the available coil winding area of a transformer having a desired operating parameters and/or specifications other than that of the provided exemplary embodiment, the same principle and calculation discussed above may be likewise applied.

Thus, given the condition of operating frequency of 60~120 KHz and input power of 8~40 W, the optimum available coil winding area of the low profile transformer (1) can be obtained through the abovementioned method, which can help designers determine the necessary number of coil winding turns, thus keeping the turns of coils at the necessary minimum to maintain low profile (thickness) of the transformer (1).

Provided below is a specification chart of several conventional transformer core units and that of the instant disclosure:

| | Cross-section $A_e$ ($mm^2$) | The height of the inserting portion (mm) | Available coil winding area, Length (L) × Width (W) ($mm^2$) | Total Height (mm) |
|---|---|---|---|---|
| Conventional transformer 1: EE16/14 | 18.5 | 4.8 | 10.4 × 3.85 = 40 | 4.8 + 3.85 × 2 = 12.5 |
| Conventional transformer 2: EF16/16 | 20.1 | 4.8 | 11.8 × 3.57 = 42.1 | 4.8 + 3.57 × 2 = 11.94 |
| Conventional transformer 3: EI16/14 | 18.8 | 4.8 | 10.4 × 4.05 = 42.1 | 4.8 + 4.05 × 2 = 12.9 |
| Conventional transformer 4: EE16/25 | 21.9 | 4.8 | 20.4 × 4.00 = 81.6 | 4.8 + 2.37 × 2 = 9.54 |
| Instant embodiment | 22.0 | 4.15 | 18.6 × 2.6 = 48.4 | 4.15 + 2.6 × 2 = 9.35 |

Specifically,

1. The "total height" is calculated by the total thicknesses of the inserting portion (202) of the core unit (assuming the thickness of the winding portion (101) of the frame (10) is negligible) plus the wound coils (including the coil thicknesses both above and below the winding portion (101) of the frame (1)), which is the minimum required height/thickness for the low profile transformer (1) (here in the comparison chart, the thickness of the wound coil is used to represent the coil winding width (W));
2. the value "2.37" for the height of the coil winding thickness of the conventional transformer #4 is derived by dividing the equivalent coil winding area of the transformer (1) of the instant disclosure by the coil winding length (L) of the conventional transformer #4 (which is 48.4/20.4=2.372 (mm)).

Observation of the above chart indicates that, for a given height (thickness) of the inserting portion of the iron core (in this case, 4.8 mm), the cross-sectional areas ($A_e$) of the conventional transformers are fairly close to each other.

Comparing with conventional transformers #1, #2, and #3, the cross-sectional area ($A_e$) and the available coil winding area of the instant embodiment are both noticeably larger. Accordingly, the total height (or total thickness, i.e. the thickness of the inserting portion and the width (w) of the available coil winding area) of the instant exemplary transformer (1) is noticeably less than those of the conventional transformers. As for the conventional transformer #4, although the available coil winding area thereof is larger than that of the instant embodiment, under the same coil winding conditions (i.e., using coils of identical diameters and having identical coil winding numbers), the total thickness of the conventional transformer #4 is still thicker than that of the instant exemplary transformer (1). Moreover, for conventional transformers #1, #2, #3 and #4 that do not have chamfered surfaces on the lateral portions of their iron cores, mechanical interference may occur between the pointy edge of their iron cores and the interior wall surface of a circular light tube. Therefore, although the total height of the conventional transformer #4 is similar to that of the low profile transformer (1) in accordance to the present invention, due to the mechanical interference caused by the pointy edge of the conventional design, the conventional transformer #4 still occupies more space than the transformer (1) in accordance with the instant design.

Figure 4:
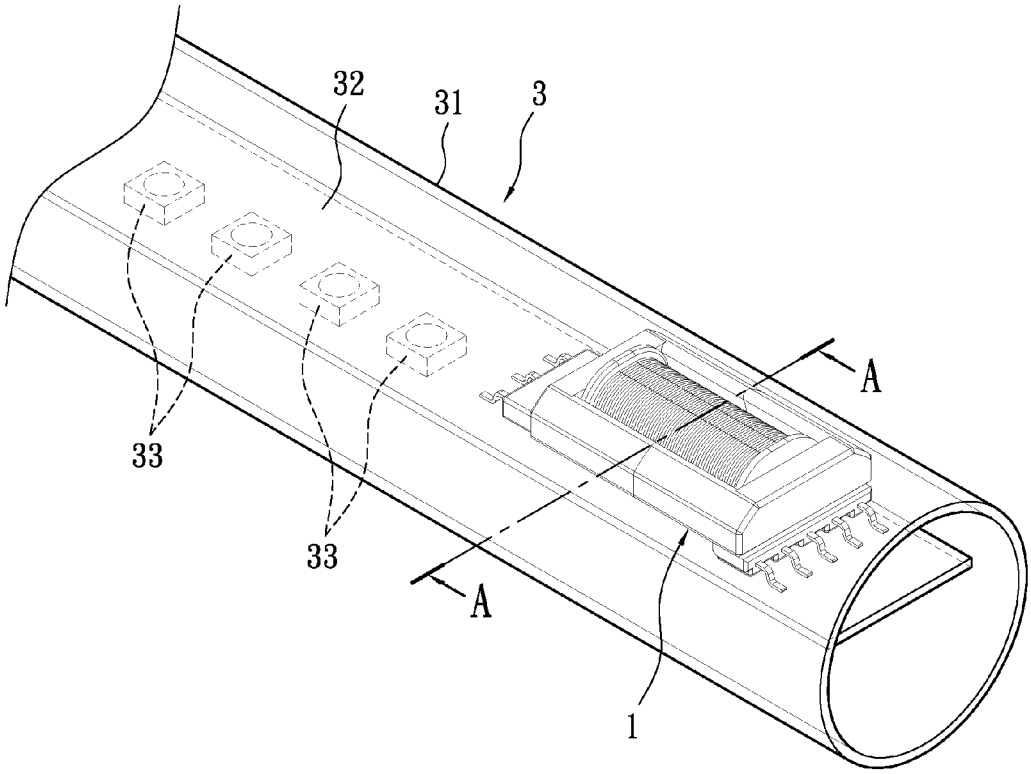
FIG. 4 shows a perspective view of a transformer in accordance with the present invention adapted on a circuit board in a tubular light.

Please refer to FIG. 4, which shows an exemplary low profile transformer (1) in accordance with the instant disclosure adapted on a circuit board (32) in a tubular light (3). The tubular light (3) comprises a light tube (31), at least one illuminating element (33), the circuit board (32), and a low profile transformer (1). The circuit board (32), the illuminating element (33), and the transformer (1) are housed inside the light tube (31). The light tube (31) may conform to the conventional tubular light specifications (such as T8 or G13 tubular light specifications) for maximum device compatibility.

Specifically, the illuminating element (33) and the transformer (1) are disposed on the circuit board (32) in electrical connection. Preferably, the illuminating element (33) is of LED type (light emitting diode). The number of illuminating element (33) shall depend on specific operational requirement, and not be limited to the exemplary illustration provided herein.

The technical detail of the low profile transformer (1) has been discussed above and thus will not be repeated.

Figure 6:
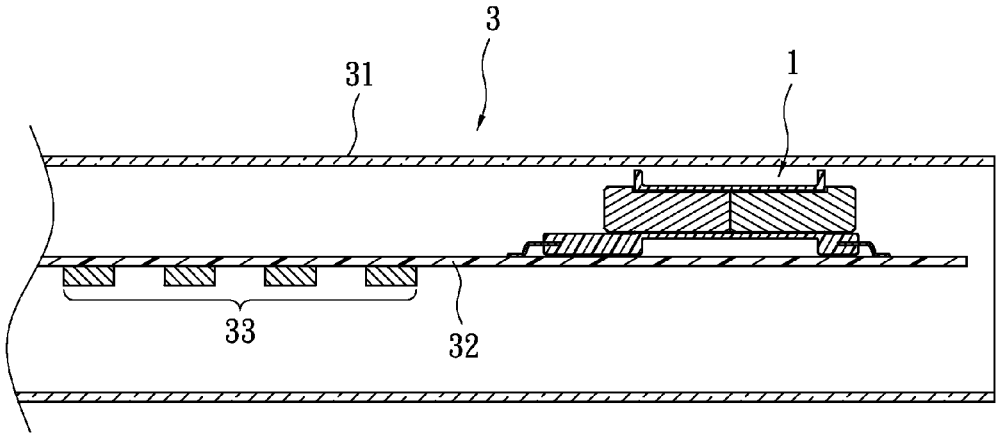
FIG. 6 shows a longitudinal cross-sectional view of a tubular light that utilizes a transformer in accordance with the present invention.

Please refer to FIGS. 5 and 6, which respectively show the transverse and longitudinal cross-sectional diagrams of a light tube utilizing a low profile transformer (1) in accordance with the instant disclosure. It can be clearly seen from the cross-sectional diagrams that, cooperatively, the chamfered edges of the flanges (102) and the chamfered surfaces of the lateral portions (203) enable much tighter fitment of the low profile transformer (1) in the circular light tube (31). In addition, the flatly arranged elliptical cross sectional area of the winding portion (101) further contributes to the reduction of transformer height/thickness and improves overall space utilization thereof in the circular light tube. As the upper portion of the transformer (1) is chamfered in a fashion that conforms to the contour of the inner surface of the light tube (31), the transformer (1), along with the circuit board (32) on which it is mounted, can be installed much closer to the interior surface of the light tube (31), thereby optimally utilizing the limited available inter-tubular space. Moreover, as the circuit board (32) is allowed to be skewedly arranged toward to one side of the light tube (31), the illuminating elements (33) arranged on a reverse side of the circuit board (32) may obtain wider illuminating angle.

The low profile transformer (1) may be suitably adapted in not only a tubular light but also other low profile electronic devices, for example, in the power supply unit of a low profile panel display/television.

Figure 7:
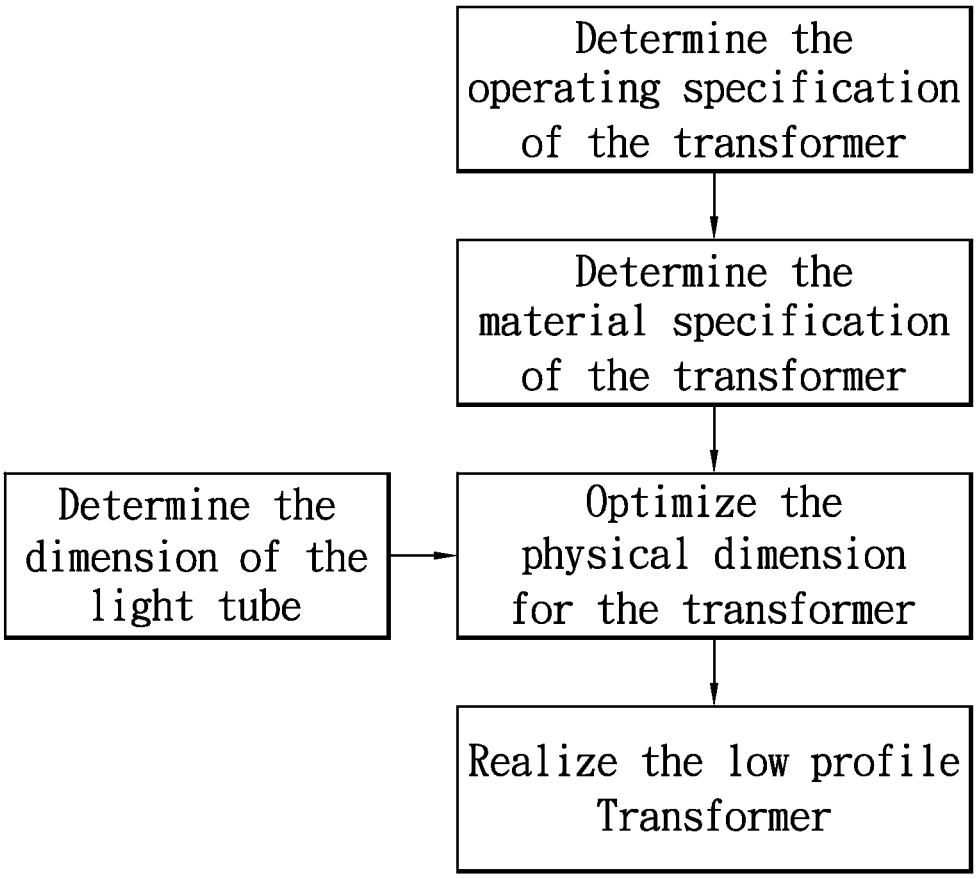
FIG. 7 shows a design flow-chart for the transformer in accordance with the present invention.

Please refer to FIG. 7, which illustrates a design flow-chart of the transformer (1) in accordance with the present invention particularly adaptable in a tubular light device (3). The design procedure comprises exemplary steps listed as follows, which do not necessarily follow the order as listed:

1. Determine the operating specification of the transformer (1). For example, the minimum input voltage ($V_{in_min}$), the output voltage ($V_o$), the operating frequency (fre), and the input power ($P_{in}$).

2. Determine the material specification of the transformer (1). For example, the change in magnetic flux density (ΔB) of the core unit, the cross-sectional area ($A_e$) of the inserting portion (202), the primary coil winding number ($N_p$), and the coil winding ratio (N). Specifically, the input voltage ($V_{in_min}$), the output voltage ($V_o$), the operating frequency (fre), the magnetic flux density variation (ΔB), the cross-sectional area ($A_e$), the coil winding ration (N), and the primary coil winding number ($N_p$) are necessary design parameters in the characteristic equation previously introduced. Particularly, parameters ($A_e$) and (ΔB) correspond to the dimensional and material specifications of the core unit, respectively, where the maximum value of ΔB is limited by the characteristics of a selected material. By plugging into the abovementioned characteristic equation certain pre-determined design parameters, we may obtain a characteristic function of effective area $A_e(N_p, N)$ that is beneficial to the design analysis of the transformer. For example, once the input voltage ($V_{in_min}$), the output voltage ($V_o$), the operating frequency (fre), and the magnetic flux variation (ΔB) are selected/determined (or arbitrarily decided according to specific operational requirements), we may plug these pre-determined parameters into the characteristic equation $$A_e = \frac{V_{in_min} D(V_{in_min}, N, V_o)}{N_p \Delta B \cdot fre}$$

and obtain an equation of cross-sectional area ($A_e$) as a function of coil winding number and turn ratio ($N_p$, N). Using suitable numerical/graphical analytical tools, we can then plot the solutions of this characteristic function $A_e(N_p, N)$ in a three dimensional solution space in a fashion illustrated in FIG. 8, which provides convenient and reliable references that can aid the design of a low profile transformer. Likewise, we may pre-select design parameters for $V_{in_min}$, $V_o$, fre, and $A_e$, and plug these pre-determined values into the characteristic equation to obtain a characteristic magnetic flux variation function $\Delta B(N_p, N)$, which can be analyzed by a proper numeral analytical tool in a similar fashion to create another three dimensional solution space, thereby aiding the design analysis of the low profile transformer. Nevertheless, the instant embodiment utilizes the function of cross-sectional area $A_e(N_P, N)$ for the following exemplary illustration.

3. Determine the dimension of the light tube (3). According to the interior dimension of the light tube (3), we can further refine the design of the cross-sectional layout of the inserting portion (202), as well as the cross-sectional arrangement (particularly, the transverse cross-section) of the frame unit (10) and the core unit, particularly around the upper portions of the flanges (102) and the lateral portions (203). Please refer to FIGS. 5 and 6 for the following discussion. For example, for space usage optimization, the cross-section layout of the inserting portion (202), which directly affects the structural arrangement of the coil windings (2), is preferably of a flatly arranged elliptical shape. The flatly arranged elliptical cross-section of the insertion portion (202) and the coil winding portion (101) shapes the upper exposed portion of the wound coil into a curved/arced surface that locally conforms to the inner contour of a light tube. Moreover, in order to enable tighter fitment of the transformer (1) in the circular light tube (31), the flange (102) of the frame unit (10) is designed to incorporate a rounded corner/elliptically arced edge (1021) at the upper portion thereof. The flange (102) is adapted to provide structural retention of the coil windings on the winding portion (101), the upper portion thereof is thus preferably arranged in conformance with the contour of the wound coil. Thus, each of the lateral portions (203) of the core unit is provided with an upward facing beveled edge (chamfered surface 2031), which enables the transformer (1) to be arranged closer to the circular inner surface of the light tube (31). An available coil winding space is determined by the structural layout of the transformer (1) and the surroundings (such as the circuit board (32) and the inner surface of the light tube (31)), and is particularly defined by the width (W)

between the winding portion (101) and the lateral portion (203) (or alternatively, the width (W) may be defined as the gap width between the inserting portion (202) and the lateral portion (203), assuming the thickness of the winding portion (101) is neglectable), the height (H) between the top surface of the winding portion (101) and the inner surface of the light tube (31), and the length (L) between the flanges (102) of the frame unit (10) (it is worth noting that, the width (W) and the length (L) define the cross-sectional area of the winding space (204) previously discussed). Furthermore, the design feature in accordance with the instant disclosure enables tight fitting of the transformer unit against the inner wall surface of the light tube (31), preferably allowing the height (H) and the width (W) to be substantially equal (H=W). Accordingly, in the instant design step we determine the cross-sectional area (i.e. the "actual" cross-sectional area ($A_{e_act}$)) of the core member and the parameters of the width (W) and the height (H) for the available coil winding space.

It should be noted that, in order to attain better magnetic inducting performance, the total transverse cross-sectional area of the lateral portions (203) is preferably equal to that of the inserting portion (202). Moreover, because the cross sectional shape of the lateral portions (203) and the insertion portion (202) is a key factor that affects the space optimization in a light tube, it is preferable to design the core member (20) in such a way that, when viewed from a lateral direction, the top surface of the inserting portion (202) is horizontally lower than that of the lateral portions (203). The lower horizontal arrangement of the insertion portion (202) may help to achieve substantially identical dimension of the available coil winding width (W) and the available coil winding height (H) (i.e., W=H; please refer to FIG. 5).

4. Determine and calculate the optimal physical dimension for the low profile transformer (1) according to the abovementioned operating specifications and material specifications. Specifically, after determining the dimensions of the actual cross-sectional area ($A_{e_act}$) and the available coil winding width (W), a suitable solution pair of the primary coil winding number and the coil winding ratio ($N_p$, N) may be selected from the three dimensional solution space of the characteristic function $A_e(N_p,N)$. Subsequently, the secondary coil winding number ($N_s$) may be obtained through the primary coil winding number ($N_p$) and the coil winding ratio (N). Furthermore, as provided in the previous example, the physical dimensions of the primary and the secondary coils (such as the coil diameters thereof) may be derived from the operating specifications of the low profile transformer (1). Therefore, the total required coil winding area ($A_{total}$) for the low profile transformer (1) may be estimated (by multiplying the cross-sectional area of the primary/secondary coil by the number of turns. For example: $A_p=N_p*(\pi\ r_p\hat{}2)$, $A_s=N_s*(\pi\ r_s\hat{}2)$; the sum of $A_p$ and $A_s$ provides an accurate estimation for the total required coil winding area ($A_{total}$). For more detailed discussion on the abovementioned calculation, please refer back to steps 3-7 of the previously provided calculation example.

Figure 6A:
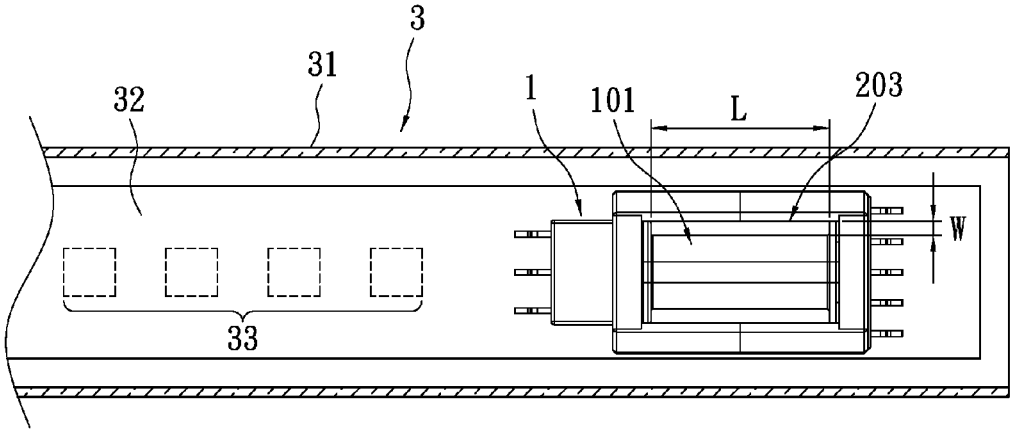
FIG. 6A shows an overhead view of the low profile transformer in accordance with the instant disclosure adapted on a circuit board in a tubular light.

Referring to FIG. 6A, which shows an overhead view of the low profile transformer (1) adapted on a circuit board (32) in a tubular light (3). With the information obtained above, it is possible to determine the required coil winding length (L) of the transformer (1) by dividing the total required coil winding area ($A_{total}$) by the coil winding width (W). Practically, for the instant embodiment where the insertion portions (202) of the core members (20) are in immediate contact without a gap in between, the coil winding length (L) is preferably equal to the total length of the inserting portions (202) of the respective core members (20) (along the direction of the long axis). Nevertheless, in other embodiments where the tips of the inserting portions (202) (of each core member (20)) do not structurally meet each other upon insertion into the winding portion (101), the gap between the core members should be neglected.

Please refer to FIG. 8, which shows a three dimensional plot whose coordinate axes respectively represent the cross-sectional area ($A_e$), the primary coil winding number ($N_p$), and the coil winding ratio (N). As previously discussed, the solutions for the characteristic function $A_e(N_p, N)$ may be represented in the three dimensional solution space in the form of a surface. The analysis of $A_e(N_p, N)$ enables a designer to define an "applicable parameter region," from which suitable design parameters for the transformer (1) (e.g. $N_p$ and N in this embodiment) may be conveniently selected in accordance to specific operating requirements of an electronic device. Specifically, Once the value of the actual cross-sectional area ($A_{e_act}$) is provided, the remaining design parameters ($N_p$) and (N) can be determined correspondingly. Generally, an "applicable parameter region" is defined in the solution space inclusively under the horizontal contour line that represents a particular ($A_{e_act}$) value (i.e., $A_e$ □ $A_{e_act}$) (under the condition of a fixedly selected ΔB value). If the selected ΔB value is modified to be greater than a previously selected ΔB value, the applicable parameter region of the solution space may be correspondingly expanded above the previously-obtained horizontal contour line of $Ae=A_{e_act}$ (i.e., $A_e>A_{e_act}$). As a specific example, if the provided actual cross-sectional area ($A_{e_act}$) is 29 $mm^2$, the region on the solution surface inclusively under the horizontal contour line where $A_e=29$ is defines as the applicable parameter region (for $A_{e_act}=29\ mm^2$). Accordingly, we may select more than one viable design parameter from the applicable parameter region. Moreover, based on specific design requirements, the applicable parameter region may be divided into more than one sub-design region (such as the sub-regions A1, A2, and A3 shown in FIG. 8). We can then select at least one reference ($N_o$) and (N) value from each respective sub-region and use these reference parameters to estimate the total required coil winding area ($A_{total}$) (using the calculating methods/steps discussed above). After calculating the corresponding ($A_{total}$) values for each pair of reference parameters ($N_p$, N) selected from the sub-regions, we may choose the ($N_p$, N) pair that provides the greatest value of ($A_{total}$) [i.e., ($A_{total_max}$)] as the preferable design value. Then, following the calculation set forth above in step 3, we divide ($A_{total_max}$) by the available coil winding width (W) and obtain a preferable value for the coil winding length (L), which in turn dictates the physical dimension of the inserting member (202) of the core member (20). It is worth noting that, the selection the ($N_p$, N) pair that offers the greatest ($A_{total}$) value (i.e. ($A_{total_max}$) may provide a greatest coil winding length ($L_{max}$) that offers the most degree of $N/N_p$ selection flexibility. For one thing, a transformer having an iron core that adapts the greatest coil winding length ($L_{max}$) will be able to accommodate the widest range of $N/N_p$ selection, allowing the transformer to be better fine-tuned to adapt to a wider range of specific operational requirements, hence providing a higher degree of compatibility. Furthermore, the greatest coil winding length ($L_{max}$) may provide some lead (reserved) room for the coil windings, taking into account the additional space that may be needed in order to accommodate/compensate for the possible slack between the coil windings, thus ensuring maximum coil fitment compatibility. Thus, basing on the operational requirements of a particular electronic device (such as a tubular light in the instant embodiment), a designer can select a most suitable value for ($N_p$) and (N) from the different sub-regions defined in the solution space for product analysis/simulation before actually (physically) realizing the transformer device.

Please note that, the number of sub-regions in the solution space is not limited to that provided in the instant embodiment (in this case, three). Moreover, as recited in Step 2 of the design flowchart, we may alternatively use ΔB ($N_p$, N) as the reference function for creating a three dimensional design parameter plot. As previously discussed, we may plug in ($V_{in_min}$)=90, $V_o$=50, $A_e$=$A_{e_act}$ (any $A_e$ value that is not greater than $A_{e_act}$ can be applicable), and fre=60K into the characteristic equation to obtain an alternative characteristic function ΔB ($N_p$, N). In this case, the coordinate axes of the three dimensional plot would be the magnetic flux variation (ΔB), the primary coil winding number ($N_p$), and the coil winding ratio (N), respectively. In a similar fashion, the solutions for ΔB ($N_p$, N) may be plotted in the three-dimensional solution space. Thus, we may define a plurality of "applicable parameter regions," from which suitable design parameters for the transformer (1) may be conveniently selected basing on specific operating requirements of an electronic device. However, in this case, the "applicable parameter region" would be defined in the solution space inclusively under the horizontal contour line that represents a particular (ΔB) value (denote this particular value as $\Delta B_{par}$, and for exemplary purpose, setting $\Delta B_{par}$=0.25). The rest of the calculation and determination may be carried out in a similar manner as discussed above.

5. Finally, according to the cross-sectional layout of the frame unit (10) and the core unit, the values such as the coil winding width (W), the coil winding height (H), and the coil winding length (L)), we may construct the low profile transformer (1) for adapting in the tubular light device (3).

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A tubular light, comprising:

a light tube;

a circuit board disposed in the light tube;

at least one illuminating element disposed on the circuit board; and a transformer disposed on the circuit board and electrically connected to the at least one illuminating unit, the transformer comprising:

a core unit having a pair of opposingly arranged base portions, an inserting portion, and a pair of opposingly arranged lateral portions, wherein the inserting portion has a long axis, the inserting portion and the lateral portion extend from the base portion substantially along the long axis, wherein the top-facing edge of the lateral portions is chamfered, wherein the lateral portion is spaced from the inserting portion, defining a pair of coil winding space there-between for passing coils; and at least a primary coil and a secondary coil wound around the inserting portion, wherein the primary coil has a primary coil winding number ($N_p$) while the secondary coil has a secondary coil winding number ($N_s$), the ratio of $N_p$ and $N_s$ defines a coil winding ratio (N), wherein the $N_p$ and N are selectively determined from the solution space of a characteristic effective area function $A_e$($N_p$, N) and a characteristic magnetic flux variation function ΔB($N_p$, N), which are provided by applying predetermined operational and material specifications to a characteristic equation:

$$A_e = \frac{V_{in_min} D(V_{in_min}, N, V_0)}{N_p \Delta B \cdot fre}$$

wherein $A_e$ denotes an effective cross-sectional area of an inserting portion, $V_{in_min}$ denotes minimum AC (alternating current) input voltage in [V], N denotes winding ratio between primary and secondary windings, $V_o$ denotes DC output voltage in [V], D ($V_{in_min}$, N, $V_o$) denotes duty cycle, wherein $$\frac{D}{1-D} = N\frac{V_0}{V_{in_min}},$$

Np denotes primary winding number,

ΔB denotes change in magnetic flux density in [Tesla], fre denotes operating frequency in [KHz], wherein a coil winding width (W) of the transformer is defined between the inserting portion and each of the lateral portions, wherein a coil winding length (L) of the transformer is obtained by dividing a total required coil winding area ($A_{total}$) by the coil winding width (W), wherein the total required coil winding area ($A_{total}$) is calculated from the $N_p$ and $N_s$.

2. The tubular light of claim 1, wherein the core unit comprises a pair of core members (20), each of which includes one of the base portions, an inserting sub-portion correspondingly constituting the inserting portion upon assembly of the core members, and a pair of lateral sub-portions correspondingly constituting the lateral portions upon assembly of the core members;

the transformer further including a frame unit comprising a generally hollow structure having two opposite ends, the hollow structure defining a core receiving channel for conformally receiving the inserting portion, wherein the frame unit further comprises a pair of flanges arranged at the opposite ends of the frame unit defining a winding portion there-between, the coils being wound on the winding portion of the frame unit;

wherein the transverse cross-section of the inserting portion of the core unit is substantially elliptical;

wherein the transverse cross-section of the winding portion of the frame unit is substantially elliptical;

wherein the upper portion of the flange is chamfered.

3. The tubular light of claim 2, wherein the frame unit includes two connector portions extending respectively and asymmetrically from the bottom surface of the opposite ends thereof along the long axis;

wherein each connector portion has a plurality of conducting pins disposed there on;

wherein one of the connector portion extends further away from the frame unit than the other;

wherein the frame unit further comprises a pair of flanges arranged at the opposite ends of the frame unit defining a winding portion there-between;

wherein the base portion of the core member abuts the flange upon insertion into the frame unit.

4. The tubular light of claim 1, wherein the light tube is of T8 or G13 tubular light specification.

5. The tubular light of claim 1, wherein the at least one illuminating element includes a light emitting diode (LED).

6. The transformer of claim 1, wherein the height of the top surface of then inserting portion is arranged horizontally lower than that of the lateral portion.

* * * * *